US005718063A

United States Patent [19]

Yamashita et al.

[11] Patent Number: 5,718,063

[45] Date of Patent: Feb. 17, 1998

[54] MIDSOLE CUSHIONING SYSTEM

[75] Inventors: Yoshio Yamashita; Kiyomitsu Kurosaki, both of Hyogo, Japan

[73] Assignee: ASICS Corporation, Kobe, Japan

[21] Appl. No.: 664,351

[22] Filed: Jun. 17, 1996

Related U.S. Application Data

[60] Provisional application No. 60/001,467, Jul. 17, 1995.

[51] Int. Cl.[6] ..... A43B 13/20

[52] U.S. Cl. ..... 36/28; 36/29; 36/35 B

[58] Field of Search ..... 36/29, 28, 35 B

[56] References Cited

U.S. PATENT DOCUMENTS

| | | | |
|---|---|---|---|
| 2,150,057 | 3/1939 | Fisch | 36/29 X |
| 4,133,118 | 1/1979 | Khalsa et al. | 36/29 X |
| 4,974,345 | 12/1990 | Yung-Mao | 36/28 X |
| 5,131,174 | 7/1992 | Drew et al. | 36/29 X |
| 5,220,737 | 6/1993 | Edington | 36/29 X |
| 5,313,717 | 5/1994 | Allen et al. | 36/29 X |
| 5,363,570 | 11/1994 | Allen et al. | 36/29 X |
| 5,402,588 | 4/1995 | Graham et al. | 36/28 |

FOREIGN PATENT DOCUMENTS

| | | | |
|---|---|---|---|
| 456434 | 11/1991 | European Pat. Off. | 36/29 |
| 500247 | 8/1992 | European Pat. Off. | 36/29 |

*Primary Examiner*—Ted Kavanaugh

*Attorney, Agent, or Firm*—Michael E. Zall

[57] ABSTRACT

A shoe is provided with a cushioning element, preferably a heel strike cushioning element for a sole portion of the shoe. The cushioning element includes a first chamber having substantially transparent flexible walls filled for example, with a liquid or gel cushioning material. A second chamber is provided having gas impervious, preferably substantially transparent walls which receive therebetween and enclose a portion of the first chamber. The first chamber is seated over the second chamber to form a gas filled cell between the walls of the enclosed portion of the first chamber and the walls of the second chamber. Preferably, a plurality of ribs project from the walls of the second chamber into the gas filled cell to form a plurality of gas filled pockets between the ribs, and the walls of the enclosed portion of the first chamber and the second chamber. The second chamber of the cushioning element is disposed over the sole portion. Preferably, the sole portion is constructed with openings which permit the gel composition to be viewed from the exterior of the shoe.

16 Claims, 10 Drawing Sheets

MIDSOLE CUSHIONING SYSTEM

BACKGROUND OF THE INVENTION

CROSS REFERENCE TO RELATED APPLICATION

This application is related to the provisional application U.S. Ser. No. 60/001467, filed Jul. 17, 1995 and design patent applications U.S. Ser. No. 29/052,534 (3.1-007), filed Apr. 3, 1996.

FIELD OF THE INVENTION

The present invention relates to sports or athletic shoes, and in particular, to an athletic shoe constructed with a cushioning element that minimizes impact shock, maintains optimum stability, provides a plurality of cushioning affects and is visible from the exterior of the shoe.

RELATED ART

Athletic shoes are constructed of many elements, each element having a specific function, and each element coacting with the other elements to provide support and protection to the foot. For example, there are shoes for tennis, racquetball, basketball, running, walking, baseball, football, weight lifting, cross-training, wrestling, etc., each shoe being designed for a specific activity or sport and designed to provide a unique and specific combination of traction, support and protection to enhance performance in such activity or sport.

Athletic shoes are also designed to meet the specific characteristics of the user, e.g. weight, foot width, arch height, etc. Athletic shoes are also designed to correct physical problems, such as over-pronation, and/or to prevent physical problems from developing. The design of athletic shoes has thus become a highly refined science, such shoes varying in design, function and purpose.

Generally, an athletic shoe includes two major elements, an upper and a sole. The upper is designed to snugly and comfortably enclose the foot. The sole is designed to provide cushioning, stability and to withstand, for example, many miles of running. The sole must have an extremely durable bottom surface for contact with the ground. However, since such contact may be made with considerable force, protection of the foot and leg demands that the sole also perform a shock-absorbing or cushioning function. The sole therefore typically includes a resilient, energy-absorbent material as a midsole in addition to the durable lower surface. This is particularly true for cross-training or jogging shoes designed to be used for long periods of time, e.g., over long distances.

Extensive clinical evaluations by investigators of foot and knee injuries sustained by, for example, runners and joggers, indicate that the most important factors associated with such injuries are shock absorption on impact and later foot stability. Based on injury data, these two factors appear to be of about equal importance and should be carefully considered in any improvements in athletic shoes. In this regard, it would be advantageous to provide shock absorption and lateral foot stability during impact of the foot. Additionally, it would be advantageous to have a return action or "rebound" effect to the impact of the foot so that a certain percentage of the energy expended when the foot contacts the surface can be employed to rebound the foot from the surface.

For most runners, initial foot impact occurs in the heel region. Therefore, the heel strike cushioning material, which is contained principally in the midsole of a running shoe, must have a firmness which provides for proper impact cushioning for a person of about average weight. When the runner is heavy, the heel cushioning material may "bottom out" before heel impact is completely absorbed, and shock-related injuries can result. On the other hand, if the cushioning material is too soft, poor lateral foot stability may result in injuries. As a general rule, athletic shoes, for example running shoes, which have a relatively firm midsole, particular in the heel region, provide the best lateral stability.

Most sports include some running, though many sports place additional demands on the shoe which are related to performance and/or injury prevention. Jump-land activities such as basketball, volleyball and aerobics typically produce forefoot impact forces due to initial forefoot contact followed shortly thereafter by greater rearfoot impact forces. These forces, either singularly, but more often cumulatively, can result in various lower extremity injuries to the wearer. These activities also often require mild to excessive side-to-side or lateral motions that require a stable foot platform, i.e. a stable shoe for successful and injury free performance. These activities are somewhat functionally similar to those of running but produce greater demands upon both the shoe and the lower extremities of the wearer.

There are many factors which limit the design of a cushioned midsole for protection against foot and knee injuries. The physical characteristics of the cushioning materials probably being the most important. Current cushioning for midsoles include elastomeric foam, such as ethylene vinyl acetate (EVA) foam, within a narrow mid-range of hardness. The use of elastomeric foam material by itself is limited to foams of relatively higher density and hardness. Low density and hardness foams are too soft and bottom out too quickly, i.e., they collapse to a point where they no longer function as a shock absorber under relatively low force and provide very little lateral stability. Hence, known commercial midsoles have generally been limited to higher density, relatively hard foams, a compromise between cushioning and stability. The use of a softer foam provides additional cushioning at a sacrifice to lateral stability. Conversely, the use of a harder foam enhances lateral stability at a sacrifice to cushioning. Manufacturers of footwear therefore attempt to balance cushioning and stability depending on the particular activity or sport the shoe is designed for.

Cushioning elements filled with a gel cushioning material are well known in the art. For example, U.S. Pat. No. 4,768,295 to Ito describes a gel cushioning member formed so as to have a plurality of chambers. When the cushioning member is placed in the recess formed in the sole plate, the filled chambers contact the bottom thereof and air chambers are formed between the filled chambers and the bottom of the recess. The air in the air chambers is compressed as the sole plate and the cushioning members are deformed by shock upon landing. See also U.S. Design Pat. Nos. 300,084 and 300,085 to Ito et al. and 297,381 to Sugiyama. Other gel containing cushions are described in U.S. Pat. Nos. 5,115,927 and 5,493,792 to Bates et al. Shoes containing such gel filled cushioning elements are sold, for example, by ASICS Tiger Corporation, Fountain Valley, Calif.

Additional prior art references relevant to this invention are:

U.S. Design Pat. No. 297,980 to Sugiyama describes a cushioning for a shoe midsole comprised essentially of one cell having partition walls therein.

U.S. Pat. No. 3,765,422 to Smith relates to a fluid cushion podiatric insole in the form of a flat envelope in the outline of the wearer's foot and containing a semi-liquid/solid particulate material as a flowing cushioning medium. The insole is provided with transverse dividers (ribs) which divide the insole into front and rear chambers, and longitudinal dividers which serve as flow-directing wall formations.

U.S. Pat. No. 4,100,686 to Sgarlato describes a shoe sole having a flexible bladder therein which is only partially filled with a non-compressible fluid, e.g., water, whereby the liquid can freely flow from one portion of the bladder to another portion.

U.S. Pat. No. 4,342,158 to McMahon et al describes an athletic shoe having in the heel a coned disk spring of a plastic material or a vertical stack of operatively coupled coned disk springs.

U.S. Pat. Nos. 4,342,157 and 4,472,890 to Gilbert describes the use of liquid-filled shock absorbing cushions in the heel portion and forefoot portion of a shoe. Typical liquids include water, glycerine, and mineral oil.

U.S. Pat. No. 4,431,003 to Sztancsik describes a self-adjusting medical sole and/or medical instep-raiser filled with soft plastic material, foam, granules or powder.

U.S. Pat. No. 4,506,461; 4,523,393; and 4,322,892 to Inohara describe a sports shoe sole wherein an interlayer body is provided at the heel portion with an air inclusion means such as grooves and apertures that open at least to one side of the interlayer body. The air inclusion portions open externally at each of the sides of the shoe.

U.S. Pat. No. 4,535,553 to Derderian et al. describes a shock-absorbing sole member comprised of an insert member and elastomeric foam encasing the insert member. The insert member is formed of resilient plastic material and includes a plurality of transversely and longitudinally spaced discreet shock-absorbing projections.

U.S. Pat. No. 4,567,677 to Zona relates to a water and air filled shoe insole having flow restrictions so as to restrict the flow of water and air from the metatarsal area and heel area and vice versa. The flow restrictions are said to provide a massaging action for the foot of the user.

U.S. Pat. No. 4,610,099 to Signori describes a shock-absorbing shoe sole which provides adjustably inflated pneumatic support at the rear half of the sole by an inflatable bladder therein. A removable in-sole panel provides access for repair and/or replacement of the bladder.

U.S. Pat. No. 4,616,431 to Dassler describes an athletic shoe having vertically oriented damping members. The damping members are formed as damping discs that are exchangeably insertable in cylinders. A piston is received in each cylinder for pressing against the damping discs.

U.S. Pat. No. 4,763,426 to Polus et al. describes a sports shoe with a sole which has air chambers and a foot operated pneumatic inflating device connected thereto to inflate the chambers.

U.S. Pat. No. 4,794,707 to Franklin, et al. describes a shoe that has an internal dynamic rocker element and a heel capsule made of a blown microcellular blend of polyethylene, ethylene vinyl acetate, rubber.

U.S. Pat. No. 4,815,221, to Diaz describes a shoe having an energy control system for shock absorption and for propulsion of the wearer. The energy control system includes a spring system and an overlying energy absorbing member located in a cavity in the midsole.

U.S. Pat. No. 4,817,304 to Parker et al. describes a sole member which includes a sealed inner member of a flexible material which is inflated with a gaseous medium to form a compliant and resilient insert. An elastomeric yieldable outer member encapsulates the insert about preselected portions of the insert. On the sides is a gap, i.e., opening, which permits the insert to expand into the gap during foot impact and to be viewed.

U.S. Pat. No. 4,833,795 to Diaz describes a shoe having a pivot surface located in the ball portion of the forefoot region to facilitate pivoting as the foot contacts the ground. The pivot surface defines a cushioning air pocket between the outsole and the midsole.

U.S. Pat. No. 4,843,735 to Nakanishi describes a shoe construction having a gelled material buffer/cushioning material in the sole.

U.S. Pat. No. 4,856,208 to Zaccaro describes a shoe sole which includes either two inflatable tubes that extend along the sides of the sole or a single inflatable tube that extends around the periphery of the sole. A fluid is in the inflatable tubes and moves therein as load is applied to a side of the sole.

U.S. Pat. No. 4,887,367 to Mackness et al. describes the use of resilient spherical bodies within recesses in the front portion and/or the heel portion of the sole of a shoe. The hardness of the resilient bodies can be adjusted to enhance the elasticity of the soles of the shoe by inflating, deflating and/or replacing the spherical bodies.

U.S. Pat. No. 4,918,838 to Chang describes a shoe having replaceable air bellows.

U.S. Pat. No. 4,970,807 to Anderie describes a sports shoe wherein the heal support encloses a plurality of resilient bodies, e.g., spheres, which fill the recess in the heel.

U.S. Pat. No. 5,131,174 to Drew, et al. describes a padding device for a shoe that has a flowable material therein which acts as the medium for absorbing and distributing impact forces. The padding device has a primary chamber and at least one secondary chamber. A means is provided for fluidly connecting the primary chamber with the secondary chamber. The padding device may be built into the footwear or inserted therein. The pad is positioned to coincide with the perimeter of the object to be protected, e.g., the heel of the foot.

U.S. Pat. No. 5,175,946 to Tsai describes a shoe having a replaceable pneumatic cushion or buffer therein which can release the internal pressure created by an excessive load.

U.S. Pat. No. 5,195,254 to Tyng describes a shoe sole having a plurality of recesses on the bottom of the sole and an elongated slot on the top. A "blast" device is received in the elongated slot. The device has two air bags connected to each other by a pipe. The device allows for air convection in the shoe.

U.S. Pat. No. 5,220,737 to Edington describes a cushioned sole member having means for stabilizing the left and right sides of the sole member. A cushioning means, e.g., containing a fluid, such as air, is positioned within the stabilizing means.

U.S. Pat. No. 5,224,280 to Preman et al describes a resilient channel-like member used in the sole of a shoe to provide light weight vertical and lateral support and cushioning. Windows may be included on the sides for viewing the member.

U.S. Pat. No. 5,224,277 to Sang Do describes a footwear sole with a ventilation and shock absorbing element which is substantially horseshoe-shaped disposed in a space between flaps at the heel of the shoe, with the exterior surface of the element flush with the outer heel of the shoe.

U.S. Pat. No. 5,313,717 to Allen, et al. describes a fluid filled cushioning and stabilizing bladder for a shoe that can be positioned in the forefoot, arch and/or heel areas of the shoe. The bladder(s) assume a complementary custom fitting configuration to the contours of the foot.

U.S. Pat. No. 5,337,492 to Anderie et al describes a shoe having a plurality of resilient carrier elements. The carrier elements are directed transversely with respect to the shoe and at spacings, one behind the other.

U.S. Pat. No. 5,343,639 to Kilgore, et al. describes a shoe with a midsole consisting of a heel portion with an envelope or shell having upper and lower plates between which columnar shaped support elements are disposed and viewable from the exterior of the shoe. Each support element is a two-stage cushioning element having a compressible element disposed within the other of the compressible elements. One of the compressible elements includes a resilient support element and the other of the compressible elements is a fluid-filled bladder. The first compressible element is compressible to a height which is less than the second uncompressed height and is compressible jointly with the second compressible element when it is compressed below the second uncompressed height.

U.S. Pat. No. 5,353,459 to Potter, et al. describes a method for inflating a bladder which forms part of a midsole of a shoe. The bladder is encapsulated by foam and disposed in a rearfoot region of the shoe midsole and viewable from the exterior of the shoe. The foam midsole is constructed so that the bladder element is viewable at the sides of the heel and at the rear portion of the shoe.

U.S. Pat. No. 5,353,523 to Kilgore, et al. describes a shoe with a midsole consisting of a heel portion with an envelope or shell having upper and lower plates between which columnar shaped support elements are disposed and viewable from the exterior of the shoe. Each support element comprises a compressible cushioning element with an open space and another compressible cushioning element of a pressurized bladder disposed within such open space.

U.S. Pat. No. 5,363,570 to Allen, et al. describes a shoe sole with a cushioning fluid filled bladder with a clip for holding the bladder. The clip is constructed of a resilient, flexible material that is transparent. The midsole is provided with a plurality of apertures which enable viewing of the fluid bladder with the clip.

U.S. Pat. No. 5,369,896 to Frachey, et al. describes a shoe having an airtight cushion having vertically disposed elastically deformable thermoplastic elements.

U.S. Pat. No. Des. 351,056 to Auger, et al. Shows a pneumatic cushion for a shoe.

European Patent Application, Publication No. 0 298 449 to Litchfield, describes the midsole of a shoe having an elastomeric material which has a number of spaced apart horizontal tubes extending the width of the midsole which are encapsulated in the elastomeric material. The tubes are hollow and lay side-by-side in a direction either perpendicular to the longitudinal axis of the shoe, parallel to the axis, or in any other direction functional for foot and shoe mechanics. The tubes are preferably encapsulated by the polyurethane material including encapsulation of the end of the tubes to prevent easy collapse thereof.

Patents which illustrate visible cushion means include, for example, Yung-Mao (U.S. Pat. Nos. 4,843,741 and 4,974,345), Swartz et al. (U.S. Pat. No. 4,972,611) and the aforementioned Bates, et al. (U.S. Pat. Nos. 5,155,927 and 5,493,792 and European Patent Application No. 91304053.1. This later publication describes an outsole including a clear section extending along the bottom and around both sides of the midsole to permit visual inspection of interior portions of the midsole along the bottom and both sides of the midsole.

OBJECTS AND SUMMARY OF THE INVENTION

It is an object of this invention to provide a novel cushioning element for an athletic shoe.

It is a another object of this invention to provide a shoe having a cushioning material, such as a gel, that can be viewed through the sculptured sole of the shoe.

It is a further object of this invention to provide a shoe having a gel cushioning element that is transparent and permits the viewing from the exterior of the shoe of the coaction of the gel composition with the structure of the cushioning element.

It is yet another object of this invention to provide a cushioning element that employs a combination of gel cushioning and air cushioning.

It is still a further object of this invention to provide an athletic shoe that includes a multi-action cushioning mechanism.

It is a further object of this invention to provide a cushioning element that will have a reduced weight and provide a gel/air dual action cushioning mechanism.

It is yet another object of this invention to provide a cushioning element that includes a dual action cushioning mechanism that can be viewed from the sides and bottom of an appropriately sculptured athletic shoe.

All of the foregoing objects are achieved by the athletic shoe and cushioning element of this invention. The shoe of this invention comprises:

- a sole portion;
- a cushioning element comprising:
  - a first chamber having flexible gas impervious walls filled with a cushioning material;
  - a second chamber having gas impervious walls which enclose and support a portion of the first chamber, the first chamber overlying the second chamber, to form a gas filled cell between the walls of the enclosed portion of the first chamber and the walls of the second chamber;
- the second chamber of the cushioning element overlying the sole portion.

In a preferred embodiment, a plurality of resilient ribs project between the walls of the enclosed portion of the first chamber and the walls of the second chamber to form a plurality of gas filled cells between the ribs and the walls of the enclosed portion of the first chamber and the second chamber.

It is preferred, that the cushioning material be a gel type material to provide a dual action gel/air cushioning mechanism. It is further preferred that the chamber walls be substantially transparent to permit the viewing of, for example, three sides of the cushioning element through a sculptured sole.

The foregoing and other objects, features and advantages of this invention will be apparent from the following description of the preferred embodiments of the invention as illustrated in the accompanying drawings.

DETAILED DESCRIPTION OF THE PREFERRED EMBODIMENTS

Figure 1:
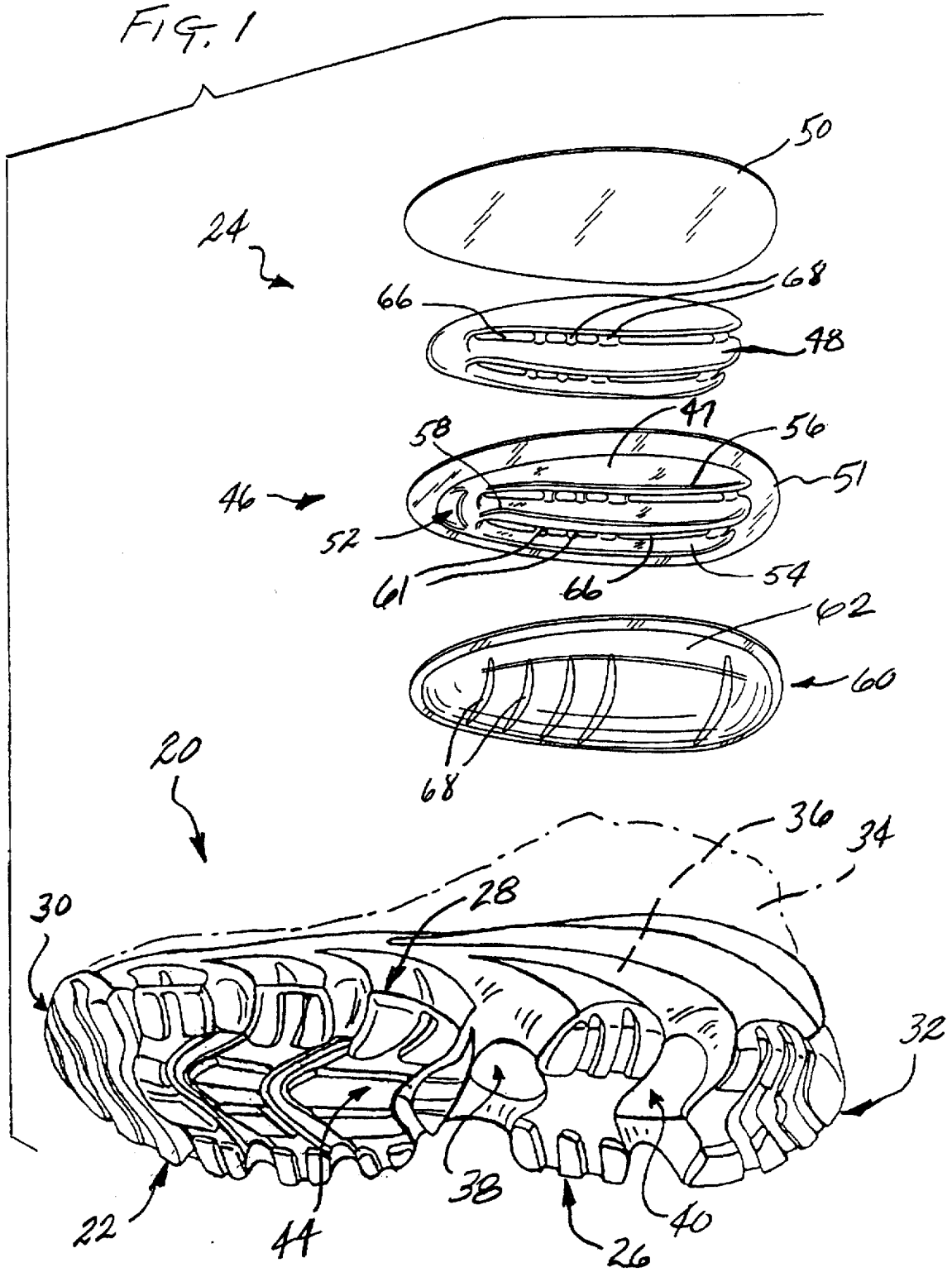
FIG. 1 is an exploded bottom perspective view of a preferred embodiment of the athletic shoe and cushioning element of this invention.
Figure 2:
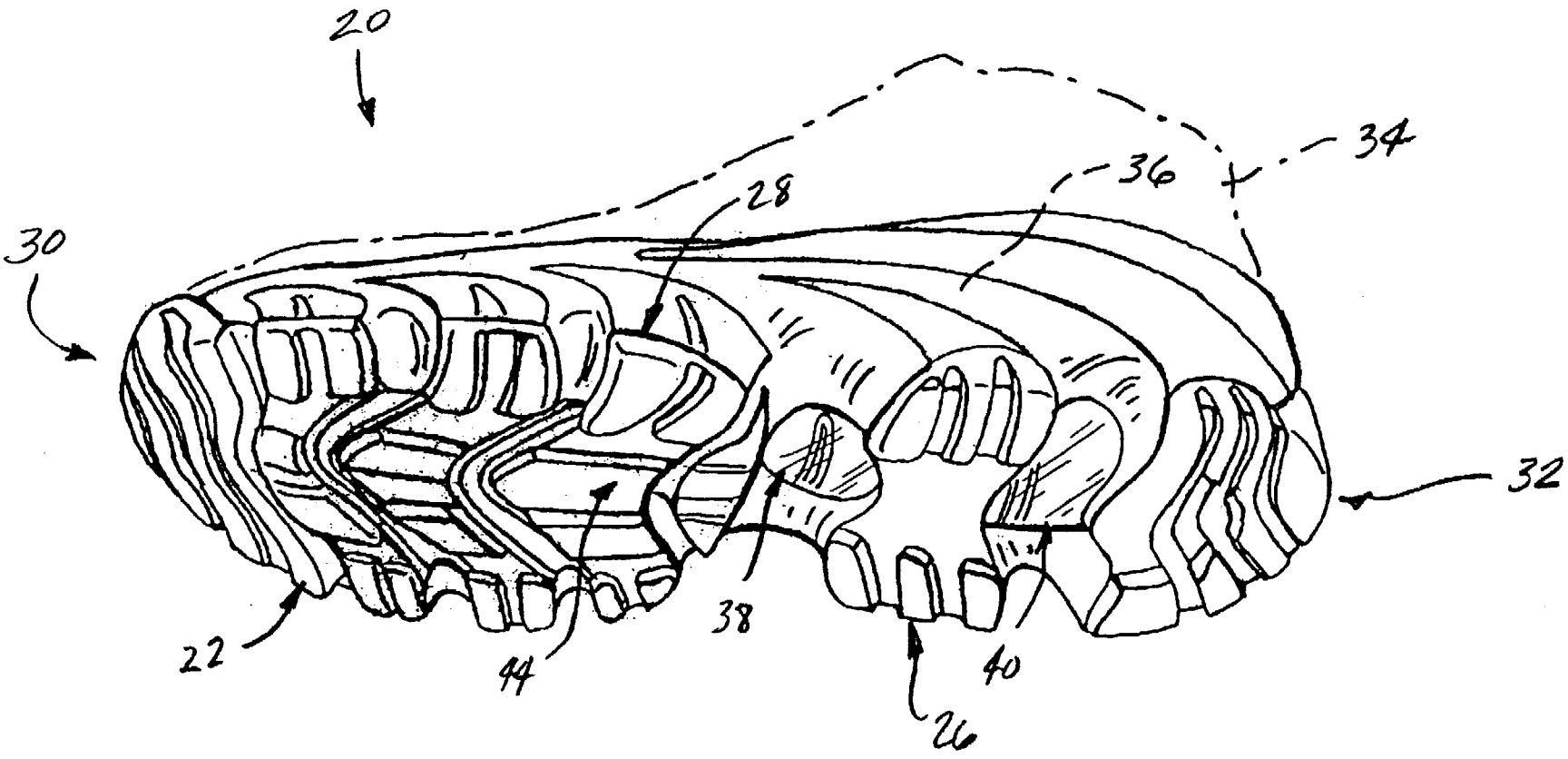
FIG. 2 is a bottom perspective view of the athletic shoe of FIG. 1, showing the cushioning element of this invention through the sculptured sole.

Referring to the drawings, and in particular FIGS. 1, 2 and 8–14, wherein like numerals indicate like elements, an article of footwear 20, such as an athletic shoe, sports shoe, or running shoe, is depicted in accordance with the present invention. Generally, the shoe 20 comprises a sole structure or member 22 and an upper 34 attached thereto. The upper 34 can be of any conventional design, while the sole structure 22 incorporates the novel features of the present invention. The sole structure 22 includes a force absorbing midsole 36 and a flexible, wear resistant outsole 44. Of course, where appropriate, the midsole 36 and outsole portions 44 can be formed as a single integral unit. The midsole 36 includes at least one cushioning element 24 of this invention. The outsole or bottom sole surface 44 may be formed into any suitable tread pattern, e.g., see FIGS. 1, 2, 9 and 10.

For ease of discussion herein, the "lateral edge" of the shoe 20 refers to the outside peripheral edge of the shoe, i.e., 26 and the "medial edge" refers to the inside edge of the shoe, i.e. 28. Further, as used herein, "distal end" refers to that end of the shoe 24 near the toes, i.e., 30, and "proximal end" refers to that end of the shoe near the heel, i.e., 32.

In all the embodiments depicted herein a "heel strike" cushioning element 24 is depicted. It should be understood, however, that such cushioning element may be of various shapes and used in various combinations, depending on the various activities for which the shoe is designed and/or the targeted costs/selling prices and market. For example, the cushioning element 24 may not only be a heel strike cushioning element as depicted in the Figures herein but may be a forefoot cushioning element or a midfoot cushioning element.

Referring to FIGS. 1, 2, 8 and 9–14, midsole 36 is preferably formed of a foam material. Referring to FIGS. 8 and 8A, and 12–14, the foam material of the midsole 36 preferably covers the upper surface or cap 50 of the cushioning element 24, as well as a major portion of the sides of the cushioning element 24. The midsole has proximal end 32, distal end 30, top surface 42 and bottom sole surface 44. Disposed in an opening 35 in the midsole 36 in the heel strike area is a heel strike cushioning element 24. The heel strike cushioning element 24 is positioned within midsole 36 such that the top surface of the cushioning element 24 is in alignment with the heel of the wearer.

The cushioning element 24 comprises a first chamber 46 constructed of flexible gas impervious walls 47 filled with a cushioning material 48. By the use of the term "gas impervious walls" it is meant that the gas, be it air or some other type of gas, that is contained in the interior of the cushioning element 24 can not penetrate through the wall to any substantial degree over the period of time of use for the cushioning element 24.

In the embodiment depicted in FIGS. 1, 8 and 12–14, the first chamber 46 comprises a flat elliptical polymeric cap 50. The cap 50 is adhered to the top of the rim 51 surrounding a polymeric elliptical capsule 52. The cushioning material 48 completely fills the chamber 46 formed by the cap 50 and capsule 52.

In a preferred embodiment, the cushioning material 48 is a gel type material, preferably a silicone type gel material, well known in the athletic foot art. Referring to FIG. 1, this gel material is injected into the first chamber 46. For ease of injection, the chamber 46 is divided into a plurality of chambers, e.g., a lateral 54, medial 56 and central chamber 58 connected by a plurality of conduits 61. The conduits 61 permit the flow of the gel into the plurality of chambers 54, 56, 58 while being injected into the first chamber 46. In the preferred embodiment depicted in FIG. 1, a gel structure cushioning material 48 is formed that conforms to the shape of the chambers 54, 56 and 58 and conduits 61.

The cushioning material may also be a liquid composition or liquid gel, optionally having particulate material therein. Preferably, the particulate density is less than the liquid density. The particulate can serve to retard the rapid transfer of the liquid composition for example, from chamber to chamber, 54, 56, 58. Additionally, the lower density particulate serves to decrease the weight of the gel or liquid cushioning material 48.

Referring, for example, to FIG. 1, if the cushioning material 48 is a liquid cushioning material, the first chamber 46 may include a plurality of partitions and/or conduits, e.g., 61, for directing the flow of liquid from one portion of the chamber, e.g., 58, to another portion of the chamber, e.g., 56.

Figure 3:
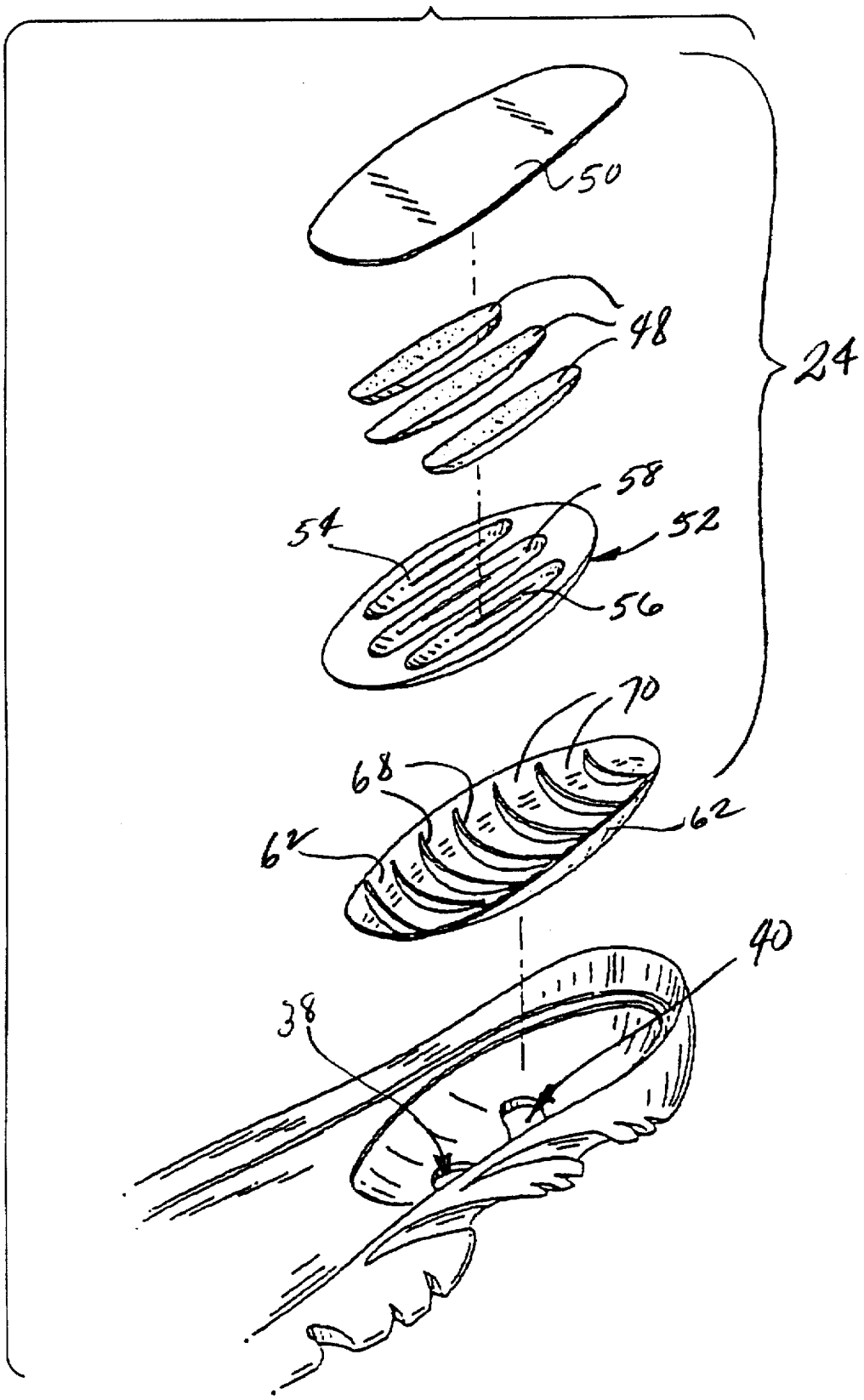
FIG. 3 is an exploded top perspective view of a portion of an athletic shoe of this invention having another embodiment of the cushioning element of this invention.

Referring to FIG. 3, alternatively, the chambers 54, 56 and 58 can be adapted to receive cushioning material 48 plugs of EVA, PU and/or gel having different durometer and/or viscosity characteristics. This permits the cushioning element 24 to be adapted to a particular activity and/or characteristic of the foot of the wearer.

Figure 4:
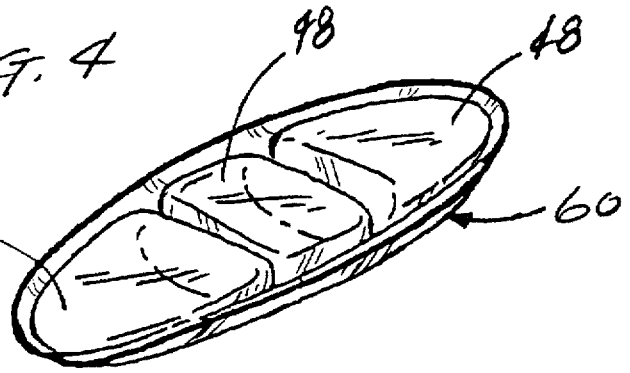
FIG. 4 is a top perspective view of a portion of still another embodiment of the cushioning element of this invention.

Referring to FIG. 4, different configurations of cushioning material 48 may be used in the first chamber 46 of the cushioning element 24. For example, a cushioning material 48 may be provided that comprises envelopes 76 constructed in different shapes to be received in the first chamber 46. Three separate and discrete envelopes 76 are depicted in FIG. 4. Each is filled with, for example a fluid, liquid, gel or even air, and arranged in the chamber 46, with two of the envelopes 76 conforming to the concave shape of the chamber 48 at its proximal and distal ends, while a third envelope is disposed intermediate thereof.

Still referring to FIGS. 1, 8 and 12–14, a second chamber 60 is provided. The second chamber 60 also has gas impervious walls 62. The walls 62 of the second chamber 60 enclose and support a portion of the first chamber 46. Preferably, the second chamber 60 is an elliptical chamber somewhat larger than the first chamber 46 and captures a gas, be it air or other gas, between the walls 47, 62 of the first and second chambers 46, 60. More specifically, the top of the rim 64 of the second chamber 60 sealingly engages the bottom of rim 51 of the first chamber 46 to support chamber 46. The bottom of rim 64 rests upon, engages and is supported by the edges of the opening 35 in the midsole 36.

The first chamber 46 thus overlies the second chamber 60, to form a gas filled cell 66 between the wails 47 of the enclosed portion of the first chamber 46 and the walls 62 of the second chamber 60.

Figure 8:
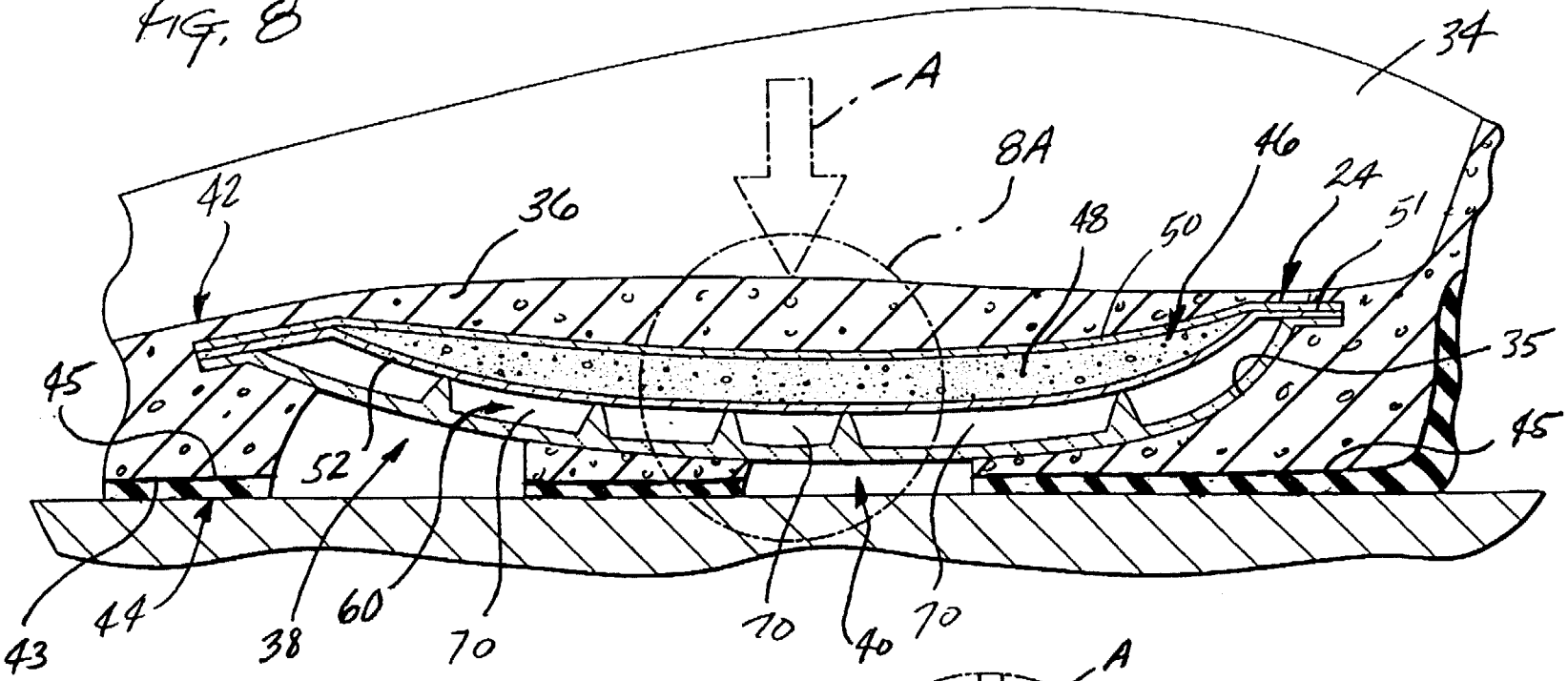

Referring to FIGS. 1, 3, 8, 11 and 12–14, in the preferred embodiment a plurality of ribs 68 project between the walls 47 of the enclosed portion of the first chamber 46 and the walls 62 of the second chamber 60 to form a plurality of gas filled cells 70 between the ribs 68, and the walls 47, 62 of the enclosed portion of the first chamber 46 and the second chamber 60. Preferably, the ribs 68 project from and are molded into and integral with the walls 62 of the second chamber 60. The ribs 68 preferably run transverse to the medial and lateral edges 26, 28 of the shoe. Referring to FIG. 8, the ribs 68, are preferably always in contact with the outer wall 47 of the first chamber, e.g., prior to and after foot strike. The ribs 68 are spaced apart increasing in length from the front and rear of the second chamber 60 toward the center of the second chamber 60.

Figure 5A:
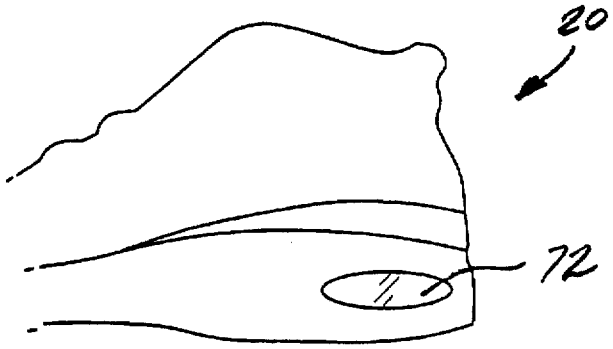
FIGS. 5A–5C are side, bottom and bottom perspective schematic views of the exterior of the athletic shoe of this invention, depicting various openings or windows in the sole of the shoe for viewing the cushioning element of this invention.
Figure 5B:
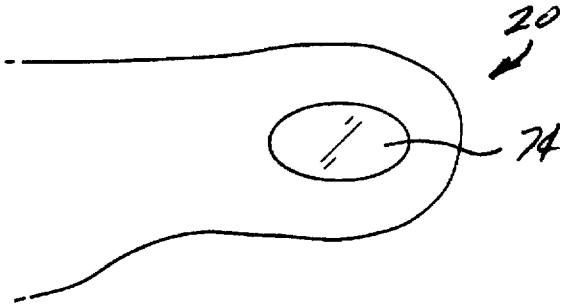
Figure 5C:
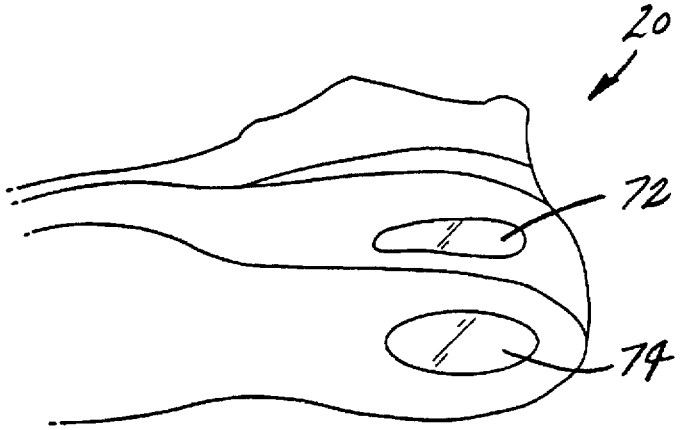
Figure 6A:
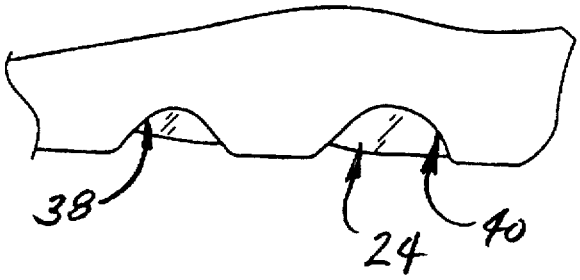
FIGS. 6A–6C are side, bottom and bottom perspective views of the exterior of the athletic shoe of this invention, depicting a sculptured shoe sole for viewing the cushioning element of this invention from three sides.
Figure 6B:
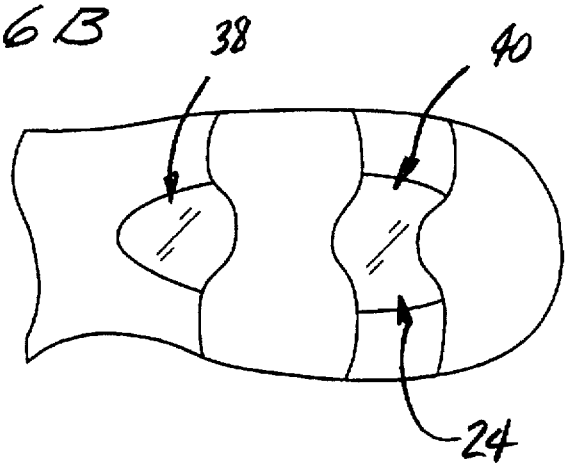
Figure 6C:
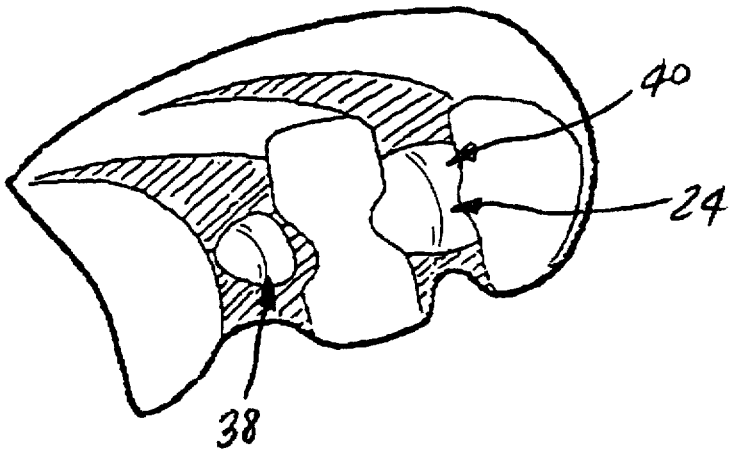

Preferably, the athletic shoe 20 is designed or sculptured in such a manner that the cushioning element 24 can be viewed from the exterior of the shoe 20. Various examples of means for accomplishing this affect are depicted in the Figures herein, see for example, FIGS. 1, 2, 5, 6, and 9–11. Referring to FIGS. 1, 2, 6, and 9–11, it is preferred that this affect be accomplished through the use of a sculptured sole portion 22 that has sculptured openings or windows 38,40 therein. Referring, for example to such Figures, the cushioning element 24 of this invention, is readily visible at the lateral and medial edges 26, 28, through the sculptured proximal and distal sole viewing windows or openings 38,40 in the sole 22. In FIG. 5, a less sculptured effect is shown wherein openings or windows 72,74 are provided on the lateral and medial edges 26, 28 of the athletic shoe 20.

Referring, for example to FIGS. 1, 2 and 12–14, preferably, the walls 47, 62 of the chambers 46, 60 of the cushioning element 24 are substantially-transparent or almost translucent to permit the coaction of all the elements to be viewed therethrough from the exterior of the shoe 20. In a preferred embodiment, the walls 47, 62 of the chambers 46, 60 are comprised of a transparent, flexible TPE material (thermoplastic elastomer), e.g. polyurethane.

Referring to FIGS. 1, 8, and 12–14, and in particular FIG. 8, cushioning element 24 is placed within the opening 35 in midsole 36. The foam material of the midsole 36 preferably adhesively covers the upper surface or cap 50 of the cushioning element 24. The top surface 45 of rubber outsole 44 is bonded, typically with an adhesive, to the bottom surface 43 of midsole 36. Suitable means well known in the art, for example adhesive means, and/or anchoring devices, can be used to adhere or attach the cushioning element 24 into the midsole 36 prior to the bonding of the midsole 36 onto top the top surface 45 of outersole 44. Upper 34 is bonded onto top the surface 42 of midsole 36 along lower edge of upper 34. Again such techniques for attachment are well known in the art.

Figure 7:
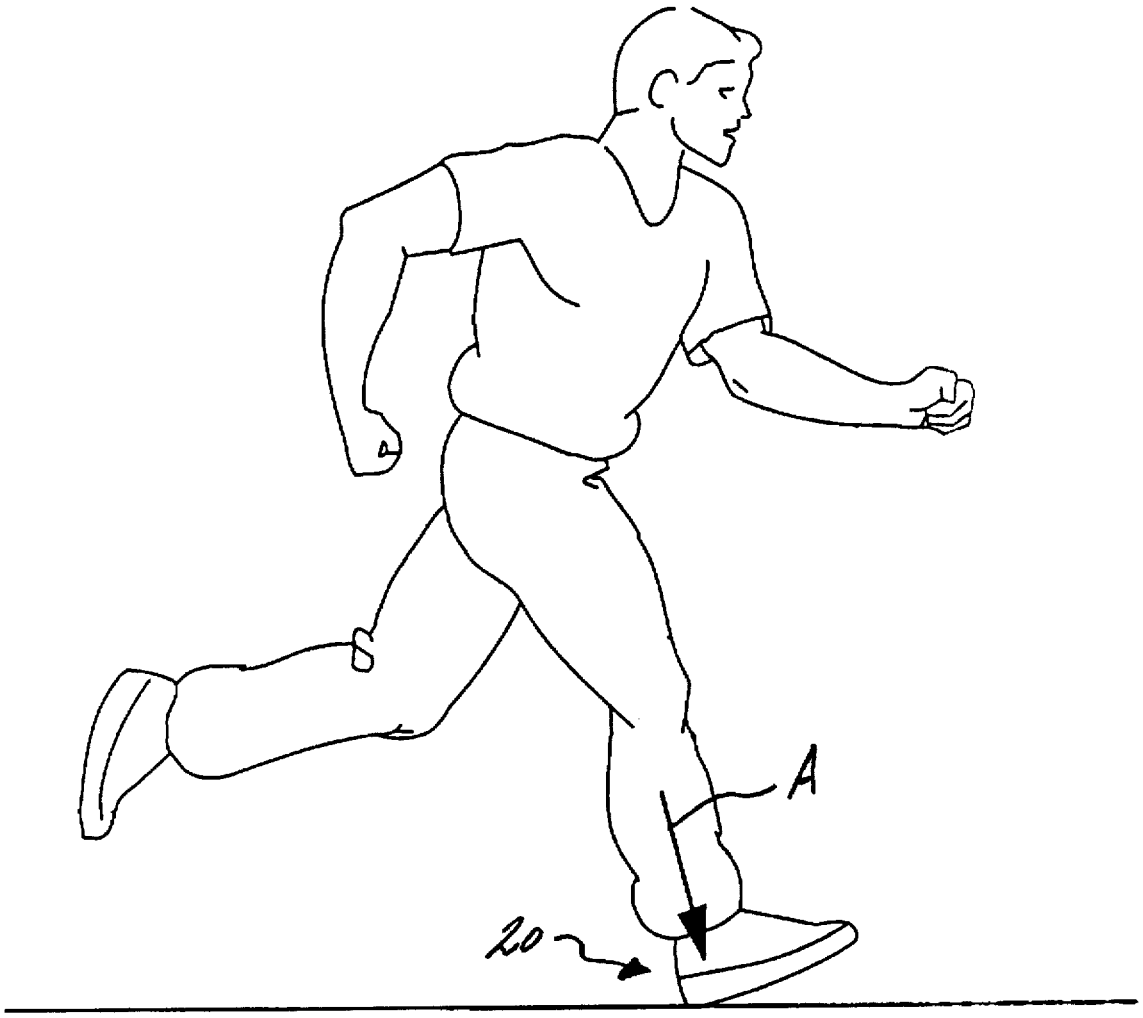
FIGS. 7, 8 and 8A depict, respectively, the creation by a runner of the impact force A on an athletic shoe (FIG. 7) and its affect on the cushioning element of this invention (FIG. 8) in producing a multi-action cushioning mechanism.
Figure 8A:
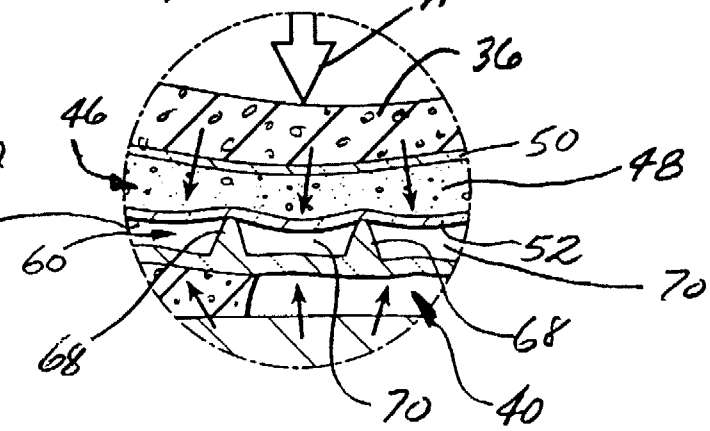
Figure 9:
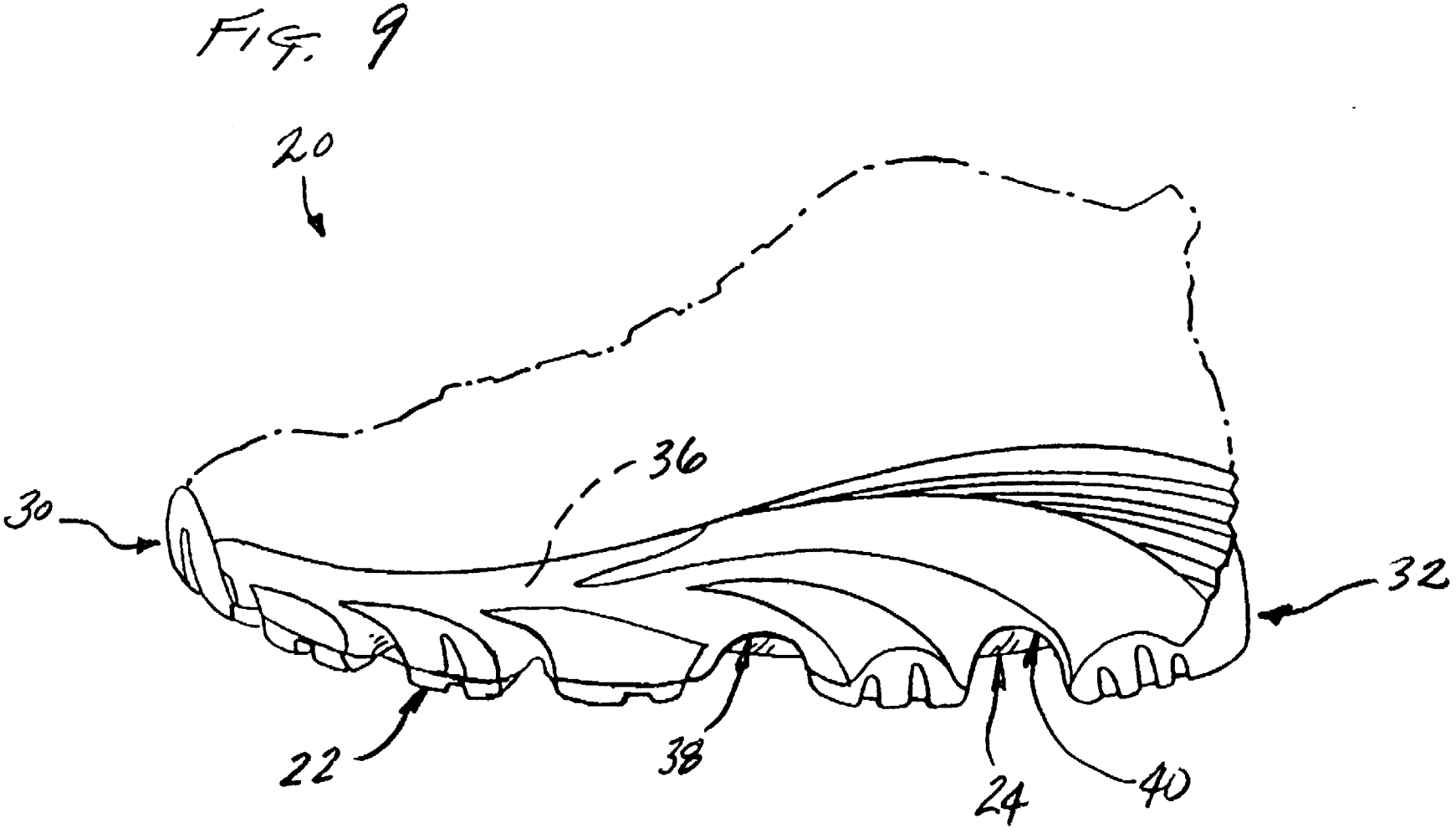
FIG. 9 is side view of a preferred embodiment of the athletic shoe of this invention.
Figure 11:
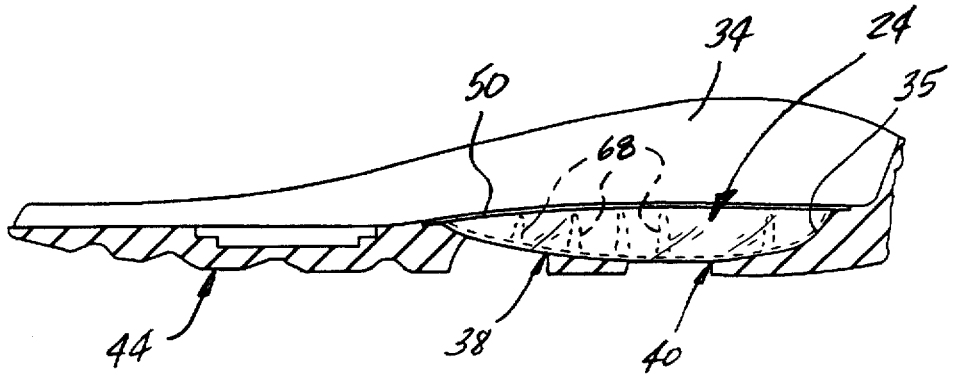
FIG. 11 is a cross-sectional view of the athletic shoe of FIG. 10, taken along line 11—11 of FIG. 10.
Figure 10:
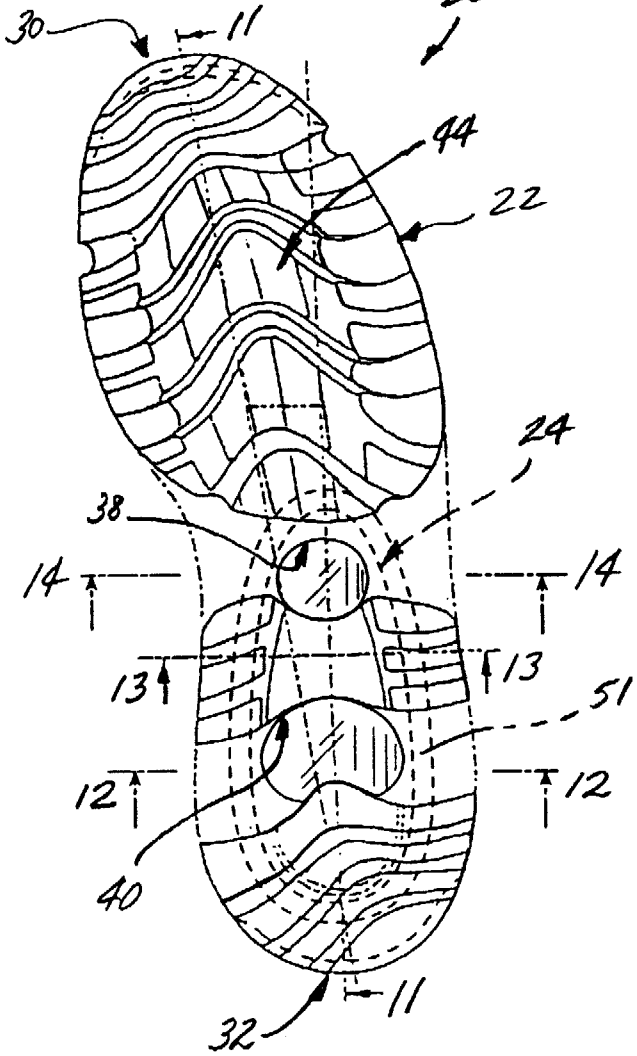
FIG. 10 is bottom view of a preferred embodiment of the athletic shoe of this invention.
Figure 12:
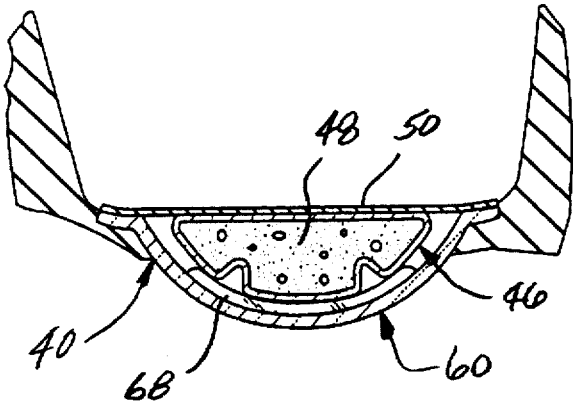
FIG. 12 is a cross-sectional view of the athletic shoe of FIG. 10, taken along line 12—12 of FIG. 10.
Figure 13:
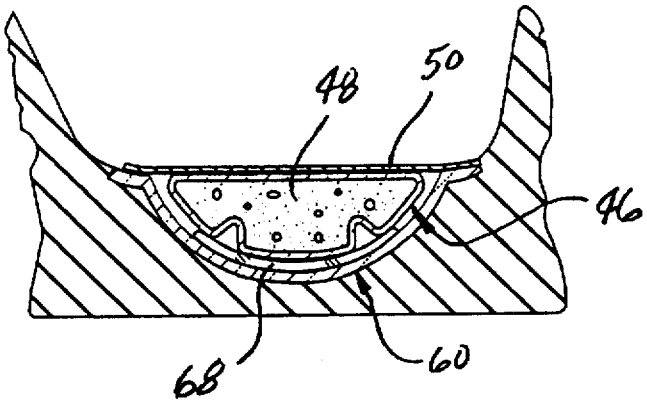
FIG. 13 is a cross-sectional view of the athletic shoe of FIG. 10, taken along line 13—13 of FIG. 10.
Figure 14:
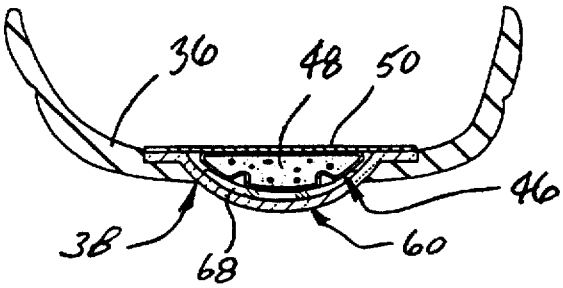
FIG. 14 is a cross-sectional view of the athletic shoe of FIG. 10, taken along line 14—14 of FIG. 10.

Referring to FIGS. 7, 8 and 8A, when the users heel impacts the ground, an impact force A is transmitted to the cap 50 of the heel cushioning element 24. Referring to FIGS. 8 and 8A, upon impact, the cushioning element 24 absorbs the force of the heel. The impact force A is absorbed by, for example the gel cushioning material 48 encapsulated in the first chamber 46, transmitting some of the force transversely through the gel material 48. The first chamber 46 is also forced downward onto the plurality of ribs 68.

The ribs 68 provide a resilient support for the downwardly forced first chamber 46. Simultaneously, the plurality of ribs 68 projecting between the walls 47 of the enclosed portion of the first chamber 46 and the walls 62 of the second chamber 60, create a sealing affect to form a plurality of gas filled cells 70 between the ribs 68, and the walls 47, 62 of the enclosed portion of the first chamber 46 and the second chamber 60. These gas filled cells 70, upon compression by the downwardly forced first chamber 46, further assist in cushioning the impact force A. Additionally, the compressed resilient ribs 68 and gas filled cells 70 provide a reactive force upward against the foot strike to not only enhance the cushioning affect, but to also provide a rebound effect.

In affect there is a multi-action cushioning affect created between the cushioning provided, for example, by the gel cushioning material 48, the resilient cushioning provided by the plurality of ribs 68, and the gaseous, e.g., air, cushioning provided by the compression of the plurality of gas filled cells 70.

Optionally, although not necessarily preferred, the plurality of ribs 68 may be omitted. The cushioning affect will then be a dual-action cushioning affect created between the cushioning provided, for example, by the gel cushioning material 48, and the gaseous, e.g., air, cushioning provided by the compression of the gas filled cell 66.

The cushioning element of this invention not only provides a multi-action cushioning affect, but also provides structural stability and sufficient lateral stability. Additionally, this invention provides for the biomechanically correct placement of the foot and self-adjusting shock absorption characteristics throughout the full range of impact of the foot against the ground.

The cushioning element 24 of this invention may be a medial motion cushioning element or a forefoot cushioning element (not shown). The cushioning element 24, including cushioning material 48, for such medial motion cushioning element or forefoot cushioning element is similar to and likewise responds similarly to, the heel strike cushioning element 24 depicted in the Figures. It should be noted however that a cushioning material 48 may be used which has different characteristics than that used in the heel strike cushioning element 24 depicted herein. Similarly, the wall structure of each element may be different, e.g. thickness, etc.

The cushioning material 48, as indicated previously, may be a gel, liquid composition or a liquid or fluid gel, optionally in combination with a particulate material. The particulate material may have a density lower than that of the gel to provide a lighter cushioning material than is obtainable with using only a gel composition. Preferably, the particulate material does not absorb the gel or liquid. The use of particulate results in a retardation of a liquid composition as it travels, for example, through the chambers 54, 56, and 58 and also produces a ball bearing effect within the cushioning material 48. Additionally, the combination of gel and particulate, when used in a cushioning element having transparent walls can be viewed from the exterior of the shoe to demonstrate the coaction of the gel and particulate in combination with the coation of the cushioning element.

Optionally, the cushioning material 48, e.g., gel, within the first chamber 46 and/or the gas filled cells, e.g., 66,70, within the second chamber 60, may or may not be pressurized.

The use of colored liquid or gel compositions within the cushioning element 20 can also enhance the visualization of the dynamic function. The particulate material can be of reflective type material or coating such as glitter, or can be of different color from the gel or liquid composition itself thereby creating a multicolored effect. Additionally, the gel or liquid composition may be of a iridescence color to enhance the visibility of both the shoe, and the wearer when jogging at night, etc.

The elastomeric foam materials from which the midsole can be made includes the following: polyether urethane; polyester urethane; ethylenevinylacetate/-polyethylene copolymer; polyester elastomer (Hytrel); nitrile rubber; ethylene propylene; polybutadiene; SBR (styrene-butadiene rubber); XNBR (carboxylated nitrile rubber).

The cushioning element 24 may be formed as a discrete individual unit having a specific cushioning and stability affect for an individual and may be removed from a shoe and transferred to another shoe.

In a preferred embodiment of the invention, the distal (toe) portion of the cushioning element 24 has a narrower construction than the opposite or proximal (heel) end of the cushioning element 24 to provide greater heel cushioning. Corresponding elements of the cushioning element 24 are sized accordingly.

The midsole cushioning element 24 of the present invention permits variation of the properties of the numerous elements of the invention to be adjusted to a user's particular foot strike, weight and the manner in which the foot attacks an underlying surface so that the tendency to "bottom out" is substantially reduced if not eliminated, before the heel impact is completely absorbed and shock related injuries can result.

The material for construction of the chambers, i.e. 46, 60, include, but are not limited to, polyurethane, Pebax, TPR; while the midsole construction can be fabricated from EVA, or Polyurethene injection molding.

It can also be appreciated by those skilled in the art that with minor design alterations the cushioning element of this invention can be readily adapted for a variety of footwear applications and for achievement of a variety of performance levels for the shoe. Modifications of the foregoing may be made without departing from the spirit and scope of the invention. While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A shoe comprising:

a sole portion;

a substantially elliptically shaped cushioning element having a longitudinal axis substantially aligned with the length of the shoe, comprising:

a first chamber having flexible gas impervious walls comprising a flat cap having a surrounding peripheral lip and a mating capsule filled with a cushioning material;

a second substantially elliptically shaped chamber having gas impervious walls which enclose the mating capsule and support a portion of the first chamber at the surrounding peripheral lip, the first chamber overlying the second chamber, to form a gas filled cell between the walls of the enclosed portion of the first chamber and the walls of the second chamber;

a plurality of ribs projecting between the walls of the enclosed portion of the first chamber and the walls of the second chamber and transverse to the longitudinal axis;

the second chamber of the cushioning element overlying the sole portion, wherein an impact force to the cap is absorbed by the cushioning material encapsulated in the first chamber and forces the first chamber downward onto ribs, the ribs providing a resilient support for the downwardly forced first chamber and creating a sealing affect to form a plurality of gas filled cells between the ribs and the walls of the enclosed portion of the first chamber and the second chamber to assist in cushioning the impact force.

2. The shoe of claim 1, wherein the cushioning element can be viewed from the exterior of the shoe.

3. The shoe of claim 2, wherein the chamber walls are substantially transparent and cushioning material can be viewed therethrough from the exterior of the shoe.

4. The shoe of claim 1, wherein the cushioning material is a liquid cushioning material.

5. The shoe of claim 4, wherein the liquid cushioning material comprises an amount of a liquid having a liquid density and an amount of particulate having a particulate density, wherein the particulate density is less than the liquid density.

6. The shoe of claim 4, wherein the first chamber includes a plurality of partitions for directing flow of liquid from one portion of the chamber to another portion of the chamber.

7. The shoe of claim 1, wherein the cushioning material is a gel cushioning material.

8. The shoe of claim 1, wherein the shoe comprises a heel strike cushioning element.

9. A shoe comprising:

a sole portion;

a substantially elliptically shaped heel strike cushioning element having a longitudinal axis substantially aligned with the length of the shoe comprising:

a first chamber having substantially transparent flexible gas impervious walls comprising a flat cap having a surrounding peripheral lip and a mating capsule filled with a gel cushioning material;

a second substantially elliptically shaped chamber having substantially transparent gas impervious walls which enclose the mating capsule and support a portion of the first chamber at the surrounding peripheral lip, the first chamber overlying the second chamber, to form a gas filled cell between the walls of the enclosed portion of the first chamber and the walls of the second chamber;

a plurality of ribs projecting between the walls of the enclosed portion of the first chamber and the walls of the second chamber and transverse to the longitudinal axis;

the second chamber of the cushioning element overlying the sole portion, the sole portion having openings therein wherein an impact force to the cap is absorbed by the cushioning material encapsulated in the first chamber and forces the first chamber downward onto ribs, the ribs providing a resilient support for the downwardly forced first chamber and creating a sealing affect to form a plurality of gas filled cells between the ribs and the walls of the enclosed portion of the first chamber and the second chamber to assist in cushioning the impact force.

10. The cushioning element of claim 9, wherein the element is a heel strike cushioning element.

11. A substantially elliptically shaped cushioning element having a longitudinal axis comprising:

a first chamber having flexible gas impervious walls comprising a flat cap having a surrounding peripheral lip and a mating capsule filled with a liquid cushioning material;

a second substantially elliptically shaped chamber having gas impervious walls which enclose the mating capsule and support a portion of the first chamber at the surrounding peripheral lip, the first chamber overlying the second chamber, to form a gas filled cell between the walls of the enclosed portion of the first chamber and the walls of the second chamber;

a plurality of ribs projecting between the walls of the enclosed portion of the first chamber and the walls of the second chamber and transverse to the longitudinal axis;

wherein an impact force to the cap is absorbed by the cushioning material encapsulated in the first chamber and forces the first chamber downward onto ribs, the ribs providing a resilient support for the downwardly forced first chamber and creating a sealing affect to form a plurality of gas filled cells between the ribs and the walls of the enclosed portion of the first chamber and the second chamber to assist in cushioning the impact force.

12. The cushioning element of claim 11, wherein the chamber walls are substantially transparent and the liquid cushioning material can be viewed therethrough.

13. The cushioning element of claim 11, wherein the liquid composition comprises an amount of a liquid having a liquid density and an amount of particulate having a particulate density, wherein the particulate density is less than the liquid density.

14. The cushioning element of claim 11, wherein the first chamber includes a plurality of partitions for directing flow of liquid from one portion of the chamber to another portion of the chamber.

15. A substantially elliptically shaped cushioning element having a longitudinal axis comprising:

a first chamber having flexible gas impervious walls comprising a flat cap having a surrounding peripheral lip and a mating capsule filled with a gel cushioning material;

a second substantially elliptically shaped chamber having gas impervious walls which enclose the mating capsule and support a portion of the first chamber at the surrounding peripheral lip, the first chamber overlying the second chamber, to form a gas filled cell between the walls of the enclosed portion of the first chamber and the walls of the second chamber;

a plurality of ribs projecting between the walls of the enclosed portion of the first chamber and the walls of the second chamber and transverse to the longitudinal axis;

wherein an impact force to the cap is absorbed by the cushioning material encapsulated in the first chamber and forces the first chamber downward onto ribs, the ribs providing a resilient support for the downwardly forced first chamber and creating a sealing affect to form a plurality of gas filled cells between the ribs and the walls of the enclosed portion of the first chamber and the second chamber to assist in cushioning the impact force.

16. A substantially elliptically shaped heel strike cushioning element having a longitudinal axis comprising:

a first chamber having substantially transparent flexible gas impervious walls comprising a flat cap having a surrounding peripheral lip and a mating capsule filled with a gel cushioning material;

a second substantially elliptically shaped chamber having substantially transparent gas impervious walls which encloses the mating capsule and support a portion of the first chamber at the surrounding peripheral lip, the first chamber overlying the second chamber, to form a gas filled cell between the walls of the enclosed portion of the first chamber and the walls of the second chamber;

a plurality of ribs projecting between the walls of the enclosed portion of the first chamber and the walls of the second chamber and transverse to the longitudinal axis;

wherein an impact force to the cap is absorbed by the cushioning material encapsulated in the first chamber and forces the first chamber downward onto ribs, the ribs providing a resilient support for the downwardly forced first chamber and creating a sealing affect to form a plurality of gas filled cells between the ribs and the walls of the enclosed portion of the first chamber and the second chamber to assist in cushioning the impact force.

* * * * *